US005696465A

United States Patent [19]

Ishizuka

[11] Patent Number: 5,696,465

[45] Date of Patent: Dec. 9, 1997

[54] SEMICONDUCTOR CIRCUIT HAVING CONSTANT POWER SUPPLY CIRCUIT DESIGNED TO DECREASE POWER CONSUMPTION

[75] Inventor: Nobuhiko Ishizuka, Tokyo, Japan

[73] Assignee: NEC Corporation, Tokyo, Japan

[21] Appl. No.: 598,260

[22] Filed: Feb. 7, 1996

[30] Foreign Application Priority Data

Feb. 8, 1995 [JP] Japan ..... 7-019624

[51] Int. Cl.[6] ..... G05F 1/10

[52] U.S. Cl. ..... 327/544; 327/538; 327/543

[58] Field of Search ..... 327/538, 540, 327/541, 543, 544, 545, 323; 365/189.09

[56] References Cited

U.S. PATENT DOCUMENTS 5,283,762 2/1994 Fujishima ..... 365/189.09
5,321,653 6/1994 Suh et al. ..... 327/541
5,347,170 9/1994 Hayakawa et al. ..... 307/296.1
5,349,559 9/1994 Park et al. ..... 327/541
5,396,113 3/1995 Park et al. ..... 327/538

FOREIGN PATENT DOCUMENTS 4-345995 12/1992 Japan .

*Primary Examiner*—Timothy P. Callahan
*Assistant Examiner*—Jung Ho Kim
*Attorney, Agent, or Firm*—Young & Thompson

[57] ABSTRACT

A semiconductor circuit has a constant power supply circuit designed to decrease power consumption. The circuit has a step-down circuit 1 for generating a control voltage, an output circuit 2 having an output transistor P3 connected to an output terminal Vint, and a switching circuit 4 for supplying the control signal to the gate of the output transistor P3 when a voltage of a power line Vcc is higher than a predetermined voltage, and for supplying the voltage of the power line Vcc to the gate of the output transistor P3 when the voltage of the power line Vcc is lower than the predetermined voltage.

13 Claims, 4 Drawing Sheets

SEMICONDUCTOR CIRCUIT HAVING CONSTANT POWER SUPPLY CIRCUIT DESIGNED TO DECREASE POWER CONSUMPTION

BACKGROUND OF THE INVENTION

1. Field of the Invention

The present invention relates to a semiconductor circuit, and more particularly, to a semiconductor circuit having a constant power supply circuit designed to decrease power consumption.

2. Description of the Prior Art

Recently, a power supply step-down circuit for stepping down a power supply voltage to a predetermined voltage is recognized as an efficient circuit for decreasing power consumption of a semiconductor circuit.

Such a power supply step-down circuit is shown in FIG. 4(A). An external power supply voltage VCC is stepped down by a step-down circuit 1 so that the stepped-down voltage controls an internal power-supply load circuit 2 to output an internal power-supply voltage Vint.

The step-down circuit 1 comprises a voltage division circuit including a resistor R and an N-channel MOS transistor N1 and a differential circuit using the divided voltage output as one of differential inputs. The differential circuit comprises N-channel MOS transistors N2 and N3 serving as a differential pair, an N-channel MOS transistor N4 for a current source, and P-channel MOS transistors P1 and P2 respectively serving as a current-mirror active load.

The drain output (differential circuit output) of the transistor N2 is used as the gate input of a P-channel MOS transistor P3 constituting an internal power-supply load circuit 2 and the external voltage VCC is applied to the source of the transistor P3. Then, a stepped-down voltage Vint is derived from the drain output of the transistor P3 to serve as the operating power supply of an internal circuit (not shown) and returned by being applied to the other (gate input of the transistor N3) of the differential inputs of the differential circuit.

The above structure performs control so that the divided voltage output (voltage at point "a") generated by the resistor R and the transistor N1 is always equal to the stepped-down output Vint.

The relation between input and output of the circuit in FIG. 4(A) is shown in FIG. 4(B) and the circuit is designed so that the stepped-down voltage Vint comes to 3 [V]' when the external voltage VCC is set to, for example, 5 [V].

However, the circuit has a problem in that the stepped-down voltage Vint comes to 3 [V]' or approx. 2 [V] corresponding to an external power-supply voltage VCC of 5 [V]' or 3 [V], respectively, and therefore, in the case of an internal circuit designed to operate at 3 [V], a Vint of approximately 2 [V] is non-standard and malfunction is therefore inevitable.

To solve the problem, another technique for controlling power-supply voltage is proposed in the Japanese Patent Laid-Open Hei 4-345995, as shown in FIG. 5. The stepped-down output of a step-down circuit 51 (the circuit in FIG. 4(A) can be used) and the external voltage VCC not passing through the step-down circuit 51 are selectively applied by a switch 52 and used as the internal voltage Vint of a semiconductor integrated circuit.

An external power-supply-voltage detection circuit 53 is used to control the switching operation of the switch 52. When the external voltage VCC is equal to or lower than a decision voltage, the external voltage VCC is directly used as the internal voltage Vint without passing through the step-down circuit 51.

Because the switching circuit 52 is constituted so as to directly apply the external voltage VCC as the internal voltage Vint, the circuit 52 has a problem that it must be constituted with a switching device having a low impedance. Therefore, the switching device occupies a large area and the cost for making the low impedance switching device is high.

Also, the step-down circuit 52 continues to generate the step-down voltage, therefore, the power consumption of the step-down circuit 52 is large.

SUMMARY OF THE INVENTION

An object of the present invention is, therefore, to provide a semiconductor circuit that does not require a low-impedance switching device.

Another object of the present invention is to provide a semiconductor circuit capable of keeping a stepped-down voltage at approx. 3 [V] even when an external power-supply voltage is either 5 or 3 [V], and providing an operating power supply with low power consumption.

To achieve the above object, the semiconductor circuit of the present invention comprises a step-down circuit connected between a first power line supplying a first voltage and a second power line supplying a second voltage for generating a first control voltage between the first voltage and the second voltage, the step-down circuit being activated in response to a control signal, an output circuit connected between the first power line and an output terminal for outputting a step-down voltage to the output terminal, and a voltage detection circuit connected between the first power line and the second power line for activating the control signal when the first voltage is higher than a predetermined voltage, and for inactivating the control signal when the first voltage is lower than the predetermined voltage.

Therefore, it is Unnecessary to directly switch external voltages, and it is unnecessary to decrease the impedance of the switching device of a switching section and to correspondingly increase the occupied area. Moreover, by properly setting the detection threshold value of the voltage detection circuit, it is possible to keep a stepped-down voltage at a standard voltage of approx. 3 [V] even when the external voltage is 5 [V] or 3 [V].

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 1:
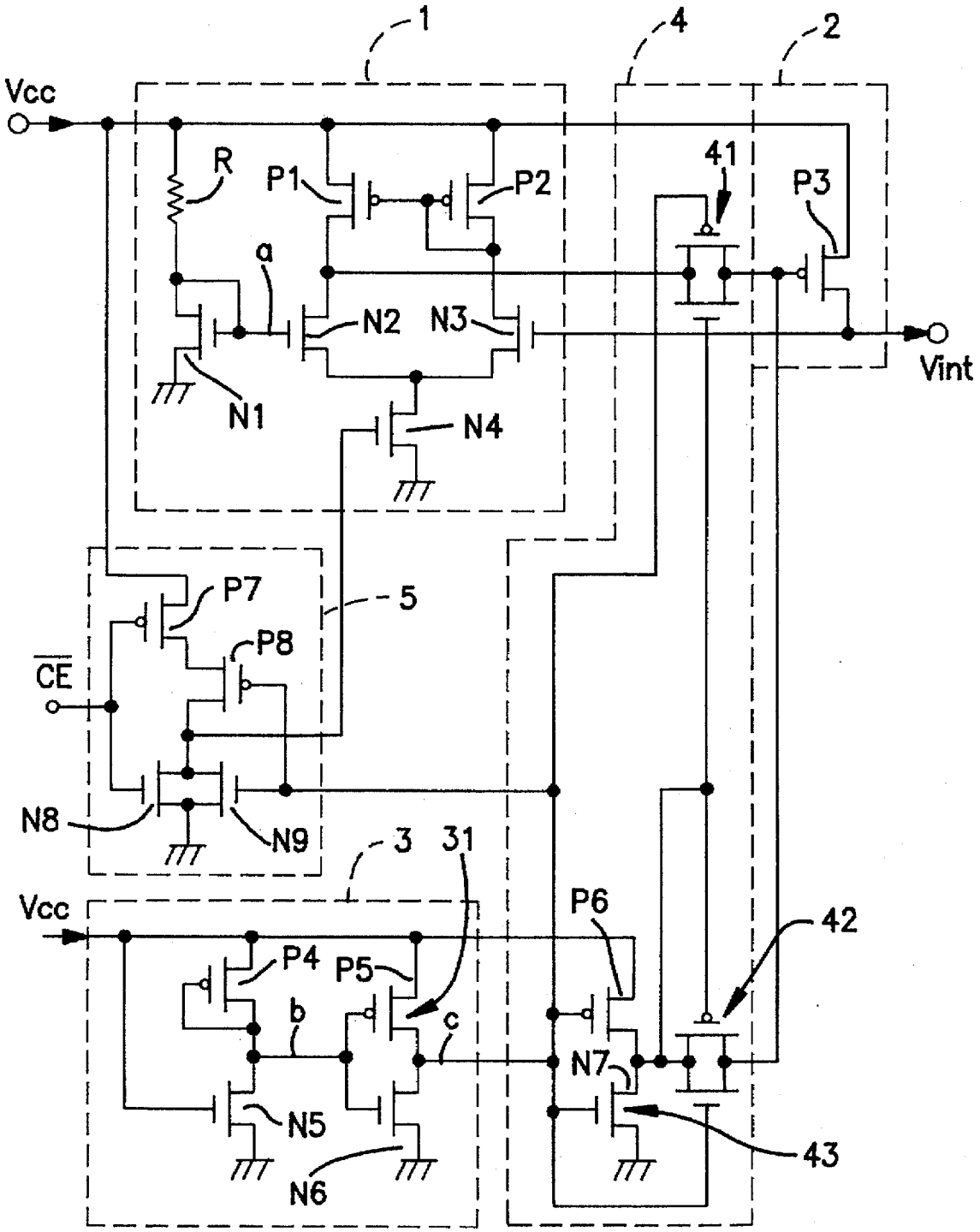
FIG. 1 is a circuit diagram of a first embodiment of the present invention.
Figure 4A:
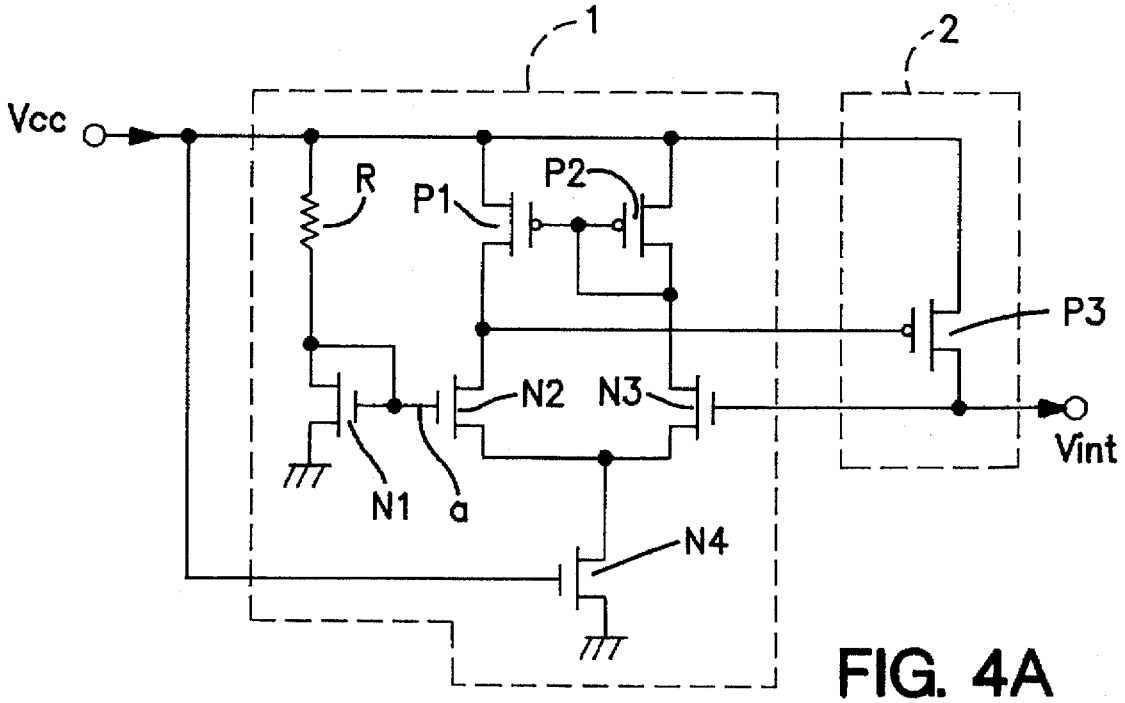
FIG. 4A PRIOR ART
FIG. 4(A) is an illustration showing a conventional power supply step-down circuit and FIG. 4(B) is an input/output characteristic diagram of the circuit.
Figure 4B:
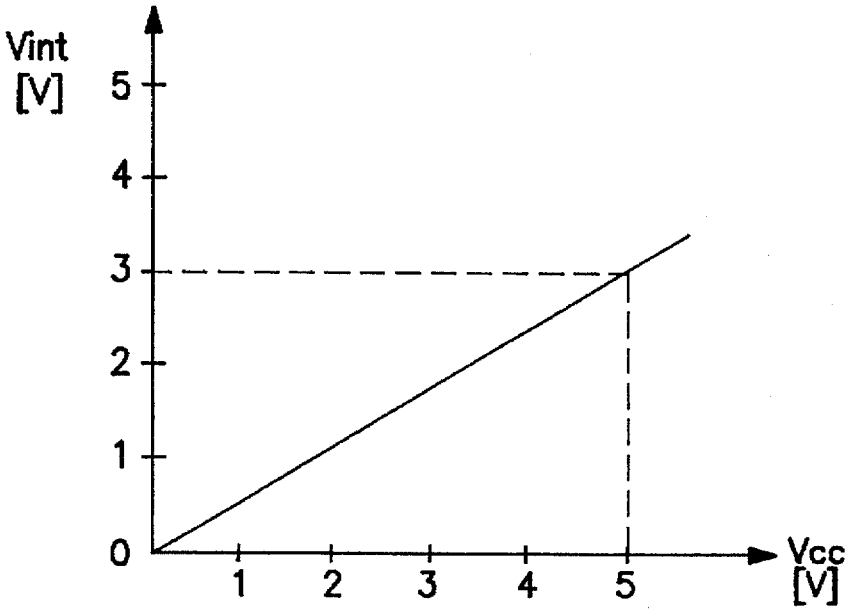
FIG. 4B PRIOR ART

A first embodiment of the present invention is shown in FIG. 1, in which elements that are the same as in FIG. 4 are provided with the same reference numbers. A switching circuit 4 is set between the output of the differential circuit (transistors N2 and N3) of the step-down circuit 1 and the gate input of the transistor P3 of the internal power-supply load circuit 2.

A voltage detection circuit 3 is used to control the switching operation of the switching circuit 4. The voltage detection circuit 3 detects the level of the external voltage VCC, and comprises a voltage division circuit including a P-channel MOS transistor P4 and an N-channel MOS transistor N5 and a CMOS invertor 31 (transistors P5 and N6) using the divided voltage output (voltage at point "b") as an input. The output (voltage at point "c") of the CMOS invertor 31 serves as a detection output signal.

The detection output signal is input to the switching circuit 4 which comprises a CMOS invertor 43 (transistors P6 and N7) using the voltage at the point "c" as an input and transfer gates (TGs) 41 and 42 to be turned on/off by input/output of the invertor 43. The transfer gate 41 turns on/off the portion between the drain output of the differential transistor N2 of the step-down circuit 1 and the gate input of the transistor P3 of the internal power-supply load circuit 2. Moreover, the transfer gate 42 turns on/off the portion between the inverted output of the detection output C of the voltage detection circuit 3 by the invertor 43 (transistors P6 and N7) and the gate input of the transistor P3.

Moreover, a control circuit 5 is used which activates the differential circuit of the step-down circuit 1. When it is assumed that an internal circuit (not illustrated) which operates by using the stepped-down power supply voltage Vint as an operating voltage is a memory circuit, the control circuit 5 comprises a P-channel MOS transistor P7 and an N-channel MOS transistor N8 respectively using a chip enable signal CE bar (CE is active low) as the gate input and a P-channel MOS transistor P8 and an N-channel MOS transistor N9 respectively using the output C of the invertor 31 as the gate input and operates as a two-input NOR circuit. The NOR output of the two-input NOR circuit serves as the gate control signal of the current-source transistor N4 of the above differential circuit.

The voltage detection circuit 3 comprises a voltage division circuit (transistors N5 and P4) and a CMOS invertor (transistors N6 and P3). Though the threshold value level of the invertor is normally set to ½ VCC, the threshold value of this embodiment is previously determined so that the output C becomes high-level when VCC is 3 [V].

Specifically, when it is assumed that the external power supply VCC is kept between 0 and 5 [V] and the stepped-down output voltage Vint is 3 [V] when VCC is 5 [V], each device constant of an invertor (transistors N6 and P5) is determined so that 4 [V] (0.8 VCC) which is the intermediate level between 3 and 5 [V] serves as a threshold value.

Figure 2:
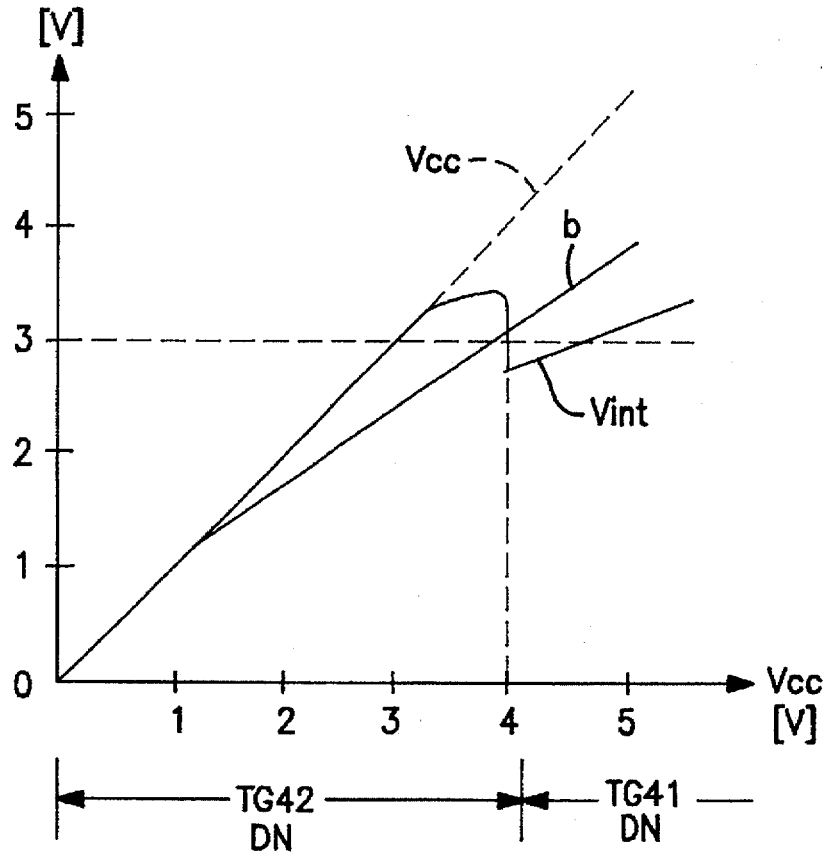
FIG. 2 is an input/output characteristic diagram of the circuit in FIG. 1.
Figure 5:
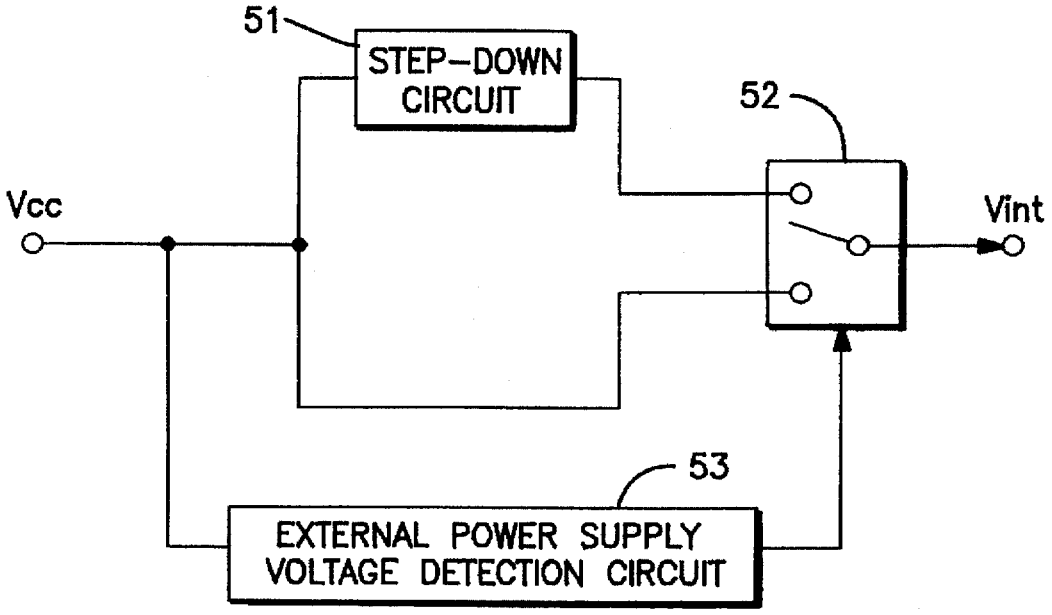
FIG. 5 PRIOR ART
FIG. 5 is an illustration showing an applied example of a conventional power-supply step-down circuit.

The relation between change of the voltage at the point "b" and change of the internal stepped-down voltage Vint to the external voltage VCC (0 to 5 [V]) in the case of the above described value is shown in FIG. 2.

When the external voltage VCC is kept between 0 and 4 [V] (threshold value of the voltage detection circuit 3), the divided voltage output at the point "b" changes as shown by symbol "b" in FIG. 2. Moreover, when VCC is approx. 1 [V], the N-channel transistor N5 is turned on and voltage dividing operation is started. In this period, the output C of the invertor 31 is kept at high level because the divided voltage output "b" is 4 [V] (threshold value) or lower. Thus, the transfer gate 42 of the switching circuit 4 is turned on and the transfer gate 41 of it is turned off.

Therefore, the output of the invertor 43 using the output C of the invertor 31 as an input is supplied to the gate of the transistor P3 of the internal power-supply load circuit 2. In this case, the output C of the invertor 31 is high-level and the output of the invertor 43 is low-level. Therefore, the P-channel transistor P3 is kept on and VCC, which is the source voltage of the transistor P3, is derived as the drain voltage of the transistor P3, that is, Vint.

When VCC rises and approaches 4 [V] which is the threshold value of the invertor 31, the source output of the transistor P3 is saturated by actions of the invertor 31 and 43 and the transfer gate 42 and remains at a level slightly higher than 3 [V].

Because the high-level output C is applied to the gate of the transistor N9 of the control circuit 5 for this period, the transistor N9 is turned on, thereby the drain of the transistor N9 becomes low-level to turn off the current-source transistor N4 of the step-down circuit 1, and the differential circuit (transistors N2 and N3) is inactivated.

When the divided voltage output "b" reaches 4 [V], the invertor 31 inverts its input, and its output C becomes low-level, and the transfer gate 42 is turned off and the transfer gate 41 is turned on. At the same time, because the current-source transistor N4 of the differential circuit is also turned on, the step-down circuit 1 is activated.

As a result, the output of the differential circuit of the step-down circuit 1 is supplied to the gate of the transistor P3 to perform step-down operation in the same manner as in the circuit of FIG. 4(A).

Moreover, the operation compensating voltage of a 3 [V]-system circuit (a circuit operating at a power supply voltage of 3 [V], that is, a circuit such as a memory using Vint as the operating power supply in the case of this embodiment) is generally kept between 2.7 and 3.3 [V] or between 3.0 and 3.6 [V]. Therefore, as shown by the voltage waveform in FIG. 2, Vint is kept between approx. 2.7 and 3.3 [V] while the external voltage VCC is kept between 3 and 5 [V]. Therefore, Vint is kept within the range of the operation compensating voltage and fully complies with the standard.

Moreover, because the output voltage Vint is almost constantly kept at approx. 3 [V] even when VCC varies between 3 [V] and 5 [V], it is ideally suited as the operating power supply of an internal circuit.

Figure 3:
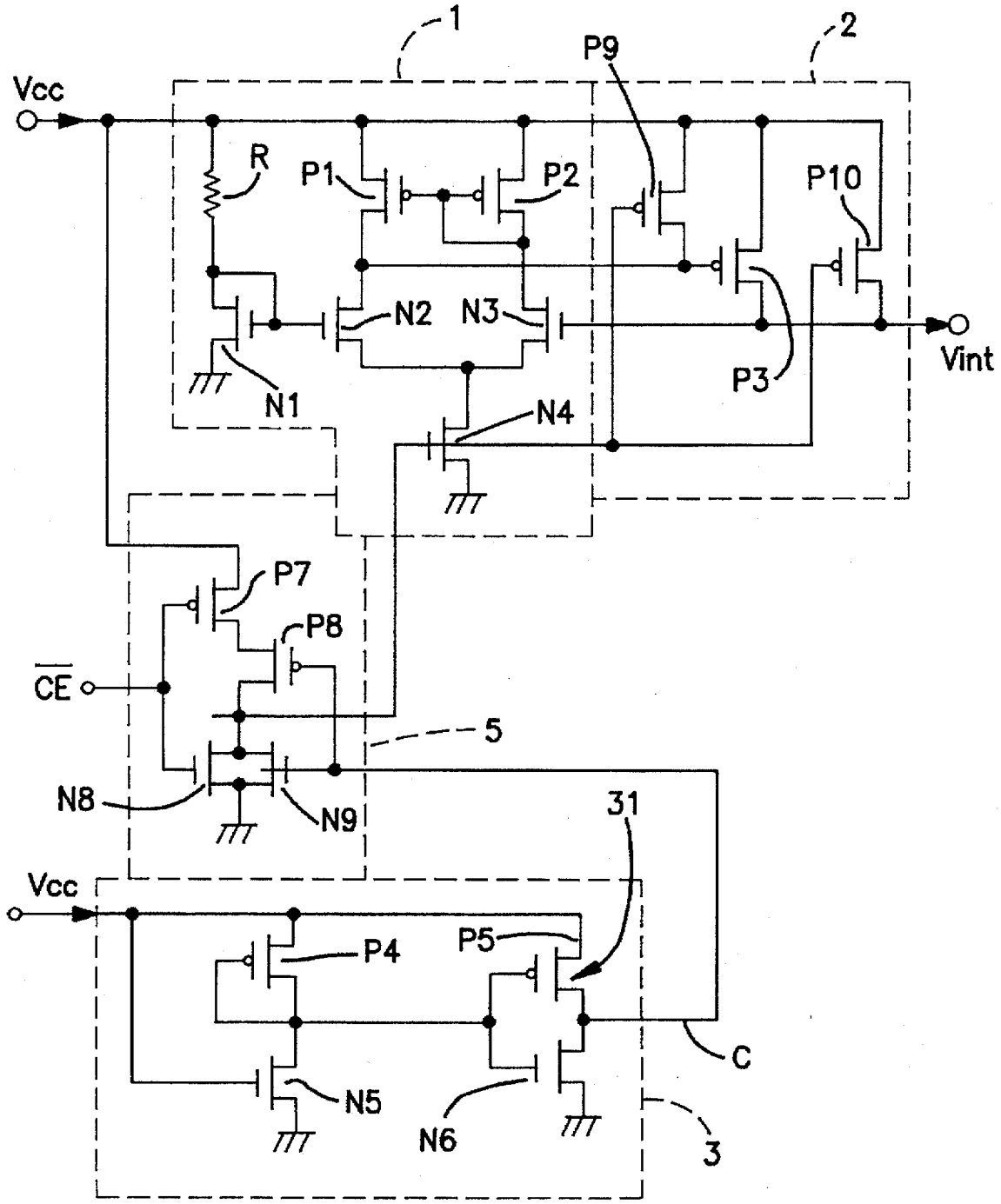
FIG. 3 is a circuit diagram of a second embodiment of the present invention.

A second embodiment of the present invention is shown in FIG. 3, in which elements that are the same as in FIG. 1 are provided with the same reference numbers. In this embodiment, a switching device is set in the internal power-supply load circuit 2 instead of setting the switching circuit 4 in FIG. 1. That is, P-channel MOS transistors P9 and P10 are turned on/off by the output of the two-input NOR circuit (transistors N8 and N9) in the control circuit 5.

The voltage VCC is applied to the sources of the transistors P9 and P10 to control the transistor P3 by the drain output of the transistor P9. Drain outputs of the transistors P3 and P10 are used in common so as to serve as the internal stepped-down voltage Vint and also returned to the input of the transistor N3 of the differential circuit.

Because the output C of the invertor 31 of the voltage detection circuit 3 is kept at high level, in the above structure, even while the external voltage VCC is kept between 0 and 4 [V], the output (drain of N9) of the two-input NOR circuit is kept at low level. Therefore, the transistors P3 and P10 are turned off and moreover, the current-source transistor N4 is also turned off and the differential circuit is inactivated.

Therefore, the output C of the voltage detection circuit 3 is applied to the gate of the P-channel transistor P10 through the invertor of the two-input NOR circuit and the circuit in FIG. 3, thereafter, functions in the same manner as the circuit in FIG. 1.

When the external voltage VCC rises to 4 [V] or higher, the output C of the invertor 31 becomes low-level. Therefore, it is apparent that the step-down circuit 1 is activated, and the P-channel transistor P3 is turned on and the P-channel transistor P10 is turned off, and the circuit in FIG. 3 also functions in the same manner as the circuit in FIG. 1.

Because the embodiment in FIG. 3 does not require the switching circuit 4 in FIG. 1, the circuit is simplified, parasitic resistances and parasitic capacitances are correspondingly decreased because of the simplification of the circuit, and the characteristic of the whole power supply step-down circuit is improved.

As described above, the present invention has an advantage in that a switching device requiring a large area is unnecessary because an internal voltage is obtained by using the output voltage of a step-down circuit by a voltage detection circuit for deciding the level of an external voltage when the external voltage is at a first-level, and using the output of the voltage detection circuit when the external voltage is equal to or lower than the threshold value level of the voltage detection circuit to control a MOS transistor in an internal power-supply load circuit.

Moreover, the present invention has an advantage in that a stepped-down output (internal voltage) in a standard range can be obtained over a wide range of an external voltages by setting the threshold value level of a voltage detection circuit between first level and normal internal voltage level.

What is claimed is:

1. A semiconductor circuit comprising:

a step-down circuit connected between a first power line supplying a first voltage and a second power line supplying a second voltage for generating a control voltage;

an output transistor connected between said first power line and an output terminal, a gate of said output transistor being connected to a first node; and a switching circuit for transferring said control voltage to said first node for supplying a step-down voltage to said output terminal in accordance with said control voltage when said first voltage is higher than a predetermined voltage, and for transferring said first voltage to said first node for supplying said first voltage to said output terminal when said first voltage is lower than said predetermined voltage.

2. The semiconductor circuit as claimed in claim 1 further comprising means for activating said step-down circuit when said first voltage is higher than said predetermined voltage, and said means for inactivating said step-down circuit when said first voltage is lower then said predetermined voltage.

3. The semiconductor circuit as claimed in claim 1 wherein said step-down circuit comprises a resistance element connected between said first power line and a second node, a first transistor of a first conductivity type connected between said second node and said second power line, a gate of said first transistor being connected to said second node, a second transistor of a second conductivity type opposite to said first conductivity type connected between said first power line and a third node, a gate of said second transistor being connected to a fourth node, a third transistor of said first conductivity type connected between said third node and a fifth node, a gate of said third transistor being connected to said second node, a fourth transistor of said second conductivity type connected between said first power line and said fourth node, a gate of said fourth transistor being connected to said fourth node, a fifth transistor of said first conductivity type connected between said fourth node and said fifth node, a gate of said fifth transistor being connected to said output terminal, and sixth transistor of said first conductivity type connected between said fifth node and said second power line, said sixth transistor being rendered conductive when said first voltage is higher than said predetermined voltage, and said sixth transistor being rendered non-conductive when said first voltage is lower than said predetermined voltage.

4. The semiconductor circuit as claimed in claim 1 wherein said switching circuit comprises a first transfer gate for transferring said control voltage to said first node when said first voltage is higher than said predetermined voltage, and a second transfer gate for transferring said first voltage to said first node when said first voltage is lower than said predetermined voltage.

5. A semiconductor circuit comprising:

a step-down circuit connected between a first power line supplying a first voltage and a second power line supplying a second voltage for generating a control voltage;

an output transistor connected between said first power line and an output terminal, a gate of said output transistor being connected to a first node;

a voltage detection circuit connected between said first power line and said second power line for activating a detection signal when said first voltage is higher than a predetermined voltage, and for inactivating said detection signal when said first voltage is lower than said predetermined voltage; and a switching circuit for transferring said control voltage to said first node for supplying a step-down voltage to said output terminal in accordance with said control voltage when said detection signal is activated, and for transferring said first voltage to said first node for supplying said first voltage to said output terminal when said detection signal is inactivated.

6. The semiconductor circuit as claimed in claim 5 wherein said voltage detection circuit has a first transistor of a first conductivity type connected between said first power line and a second node, a gate of said first transistor being connected to said second node, a second transistor of a second conductivity type opposite to said first conductivity type connected between said second node and said second power line, a gate of said second transistor being connected to said first power line, a third transistor of said first conductivity type connected between said first power line and a third node, a gate of said third transistor being connected to said second node, and a fourth transistor of said second conductivity type connected between said third node and said second power line, a gate of said fourth transistor being connected to said second node.

7. The semiconductor circuit as claimed in claim 5 wherein said step-down circuit comprises a resistance element connected between said first power line and a second node, a first transistor of a first conductivity type connected between said second node and said second power line, a gate of said first transistor being connected to said second node, a second transistor of a second conductivity type opposite to said first conductivity type connected between said first power line and a third node, a gate of said second transistor being connected to a fourth node, a third transistor of said first conductivity type connected between said third node and fifth node, a gate of said third transistor being connected to said second node, a fourth transistor of said second conductivity type connected between said first power line and said fourth node, a gate of said fourth transistor being connected to said fourth node, a fifth transistor of said first conductivity type connected between said fourth node and said fifth node, a gate of said fifth transistor being connected to said output terminal, and a sixth transistor of said first conductivity type connected between said fifth node and said second power line, said sixth transistor being rendered conductive when said first voltage is higher than said predetermined voltage, said sixth transistor being rendered non-conductive when said first voltage is lower than said predetermined voltage.

8. The semiconductor circuit as claimed in claim 5 wherein said switching circuit comprises a first transfer gate for transferring said control voltage to said first node when said detection signal is activated, and a second transfer gate for transferring said first voltage to said first node when said detection signal is inactivated.

9. A semiconductor circuit comprising:

a step-down circuit connected between a first power line supplying a first voltage and a second power line supplying a second voltage for generating a control voltage, said step-down circuit being activated in response to a detection signal;

an output circuit connected between said first power line and an output terminal for outputting a step-down voltage to said output terminal said output circuit comprising an output transistor connected between said first power line and said output terminal, a gate of said output transistor receiving said control voltage when said detection signal is activated by said voltage detection circuit and receiving said first voltage when said detection signal is inactivated by said voltage detection circuit; and a voltage detection circuit connected between said first power line and said second power line for activating said detection signal when said first voltage is higher than a predetermined voltage, and for inactivating said detection signal when said first voltage is lower than said predetermined voltage.

10. The semiconductor circuit as claimed in claim 9, further comprising a switching circuit having a first transfer gate for transferring said control voltage to said gate of said output transistor when said detection signal is activated, and a second transfer gate for transferring said first voltage to said gate of said output transistor when said detection signal is inactivated.

11. The semiconductor circuit as claimed in claim 9, wherein said output circuit comprises a first output transistor connected between said first power ling and said output terminal, a gate of said first output transistor receiving said control voltage, said first output transistor being rendered conductive when said detection signal is activated, a second output transistor connected between said first power line and said output terminal, a gate of said second output transistor receiving said detection signal, and a control transistor connected between said first power line and said gate of said first output transistor, a gate of said control transistor receiving said detection signal, said control transistor being rendered non-conductive when said detection signal is activated.

12. The semiconductor circuit as claimed in claim 11, wherein said voltage detection circuit comprises a first transistor of a first conductivity type connected between said first power line and a second node, a gate of said first transistor being connected to said second node, a second transistor of a second conductivity type opposite to said first conductivity type connected between said second node and said second power line, a gate of said second transistor being connected to said first power line, a third transistor of said first conductivity type connected between said first power line and a third node, a gate of said third transistor being connected to said second node, and a fourth transistor of said second conductivity type connected between said third node and said second power line, a gate of said fourth transistor being connected to said second node.

13. The semiconductor circuit as claimed in claim 11 wherein said step-down circuit comprises a resistance element connected between said first power line and a first node, a first transistor of a first conductivity type connected between said first node and said second power line, a gate of said first transistor being connected to said first node, a second transistor of a second conductivity type opposite to said first conductivity type connected between said first power line and a second node, a gate of said second transistor being connected to a third node, a third transistor of said first conductivity type connected between said second node and a fourth node, a gate of said third transistor being connected to said first node, a fourth transistor of said second conductivity type connected between said first power line and said third node, a gate of said fourth transistor being connected to said third node, a fifth transistor of said first conductivity type connected between said third node and said fourth node, a gate of said fifth transistor being connected to said output terminal, and sixth transistor of said first conductivity type connected between said fourth node and said second power line, said sixth transistor being rendered conductive when said first voltage is higher than said predetermined voltage, and said sixth transistor being rendered non-conductive when said first voltage is lower than said predetermined voltage.

* * * * *